United States Patent [19]

Kanter

[11] 4,178,193

[45] Dec. 11, 1979

[54] METHOD OF IMPROVING CORROSION RESISTANCE WITH COATING BY FRICTION

[76] Inventor: Jerome J. Kanter, 12300 Hobart Ave., Palos Park, Ill. 60464

[21] Appl. No.: 800,517

[22] Filed: May 25, 1977

Related U.S. Application Data

[63] Continuation-in-part of Ser. No. 558,800, Mar. 17, 1975, abandoned.

[51] Int. Cl.[2] ..... C23C 17/00

[52] U.S. Cl. ..... 148/6; 427/11; 427/191

[58] Field of Search ..... 427/11, 191; 228/112, 228/113, 114; 118/76, 77, 78; 148/6

[56] References Cited

U.S. PATENT DOCUMENTS

| | | | |
|---|---|---|---|
| 2,378,588 | 6/1945 | Skehan et al. | 427/319 |
| 2,618,572 | 11/1952 | Parrish | 427/11 X |
| 2,640,002 | 5/1953 | Clayton | 427/11 |
| 2,914,425 | 11/1959 | McGuire | 118/76 |
| 3,025,184 | 3/1962 | Blair et al. | 427/11 |
| 3,421,201 | 1/1969 | Oberle et al. | 228/113 |
| 3,505,094 | 4/1970 | Arutunian | 427/11 |

FOREIGN PATENT DOCUMENTS

| | | | |
|---|---|---|---|
| 2114375 | 10/1972 | Fed. Rep. of Germany | 427/11 |
| 46-29361 | 8/1971 | Japan | 427/11 |

OTHER PUBLICATIONS

Burns & Bradley, Protective Coatings for Metals, 2nd Ed., 1955, Reinhold, pp. 97 and 259.

*Primary Examiner*—Ralph S. Kendall
*Attorney, Agent, or Firm*—Hume, Clement, Brinks, Willian & Olds, Ltd.

[57] ABSTRACT

The corrosion resistance of a base metal article is improved by frictionally applying a metal to the article which is capable of forming an intermetallic compound with the base

1 Claim, No Drawings

METHOD OF IMPROVING CORROSION RESISTANCE WITH COATING BY FRICTION

This application is a continuation-in-part of my copending application Ser. No. 558,800, filed on Mar. 17, 1975, abandoned.

FIELD OF THE INVENTION

This invention relates to treating the surface of the metals to improve their resistance to corrosion. More particularly it relates to treating group I, II, III, IV, VI, and VIII metals and their alloys by frictionally applying a second metal to the surface thereof, the second metal being capable of forming an intermetallic compound with the base metal.

BACKGROUND OF THE INVENTION

The need for economically improving the corrosion resistance of metals is widely recognized in the art. Corrosion is a problem that plagues the common structural metals such as iron, aluminum, magnesium and copper.

Even many exotic structural materials which have a high melting point are difficult to use in high temperature applications. For example, titanium and its alloys corrode rapidly in the atmosphere at elevated temperatures because of nitrification and oxidation. Were it not for this corrosion problem titanium would be an excellent material for applications in rockets, aircraft, nuclear reactors, heating elements, and many other high temperature applications.

It has been recognized that the titanium corrosion problem could be reduced or eliminated by forming a silicide intermetallic compound coating on the exposed surfaces. Titanium forms two silicide intermetallic compounds. The compound $Ti_5Si_3$ is a peritectic compound having a melting point of about 2120° C., which is significantly higher than titanium's melting point of 1687° C. The other silicide is $TiSi_2$ which has a melting point of 1540° C., somewhat less than that of pure titanium. Both of these intermetallic compounds have excellent corrosion resistance at high temperatures.

Several methods are outlined in U.S. Pat. No. 3,047,419, issued on July 31, 1962, for the formation of silicide coatings on titanium. The patent describes sintering, vapor deposition, flame spray, and cementation techniques for formation of titanium silicide coatings. All of these techniques are somewhat complex and involve the use of high temperatures. It would be highly desirable to form intermetallic compounds in a simple manner.

SUMMARY OF THE INVENTION

It has been discovered that the corrosion resistance of metal article (as used herein the term "metal article" includes articles which are more than 50% by weight composed of the metal in question) can be improved by frictionally applying a second constituent to the metal article which is capable of forming an intermetallic compound with the metal in question. For example, the corrosion resistance of a titanium alloy has been improved by hand rubbing silicon powder on the surface of a solid titanium base metal alloy. The same is true of other metals and appropriate second constituents.

DETAILED DESCRIPTION OF A PREFERRED EMBODIMENT

The present invention includes the discovery that the corrosion resistance of a Group IV base metal article is improved by mechanical frictional application of silicon. While the exact theory behind the improved corrosion resistance of titanium and the other metals discussed hereinafter is not completely understood, it is felt that an intermetallic compound is formed on the surface of the metal article.

The Group IV metal may be, for example, titanium, zirconium or hafnium. Special preference, however, is given to titanium because of its ready availability and many applications.

According to one preferred embodiment, a solid phase reaction is performed between the Group IV metal and the silicon by frictionally contacting the surface of the Group IV metal with a solid form of silicon, as by rubbing, brushing, buffing, shot peening, and the like. This may be performed, for example, by frictionally rubbing silicon powder against the surface of the Group IV metal. Another procedure is to apply the silicon in the form of a bar or rod to the surface to be treated. Alternatively, the silicon may be a form of particles which are impinged at high velocities against the surface to be treated. For many purposes, silicon powder may be reacted with the Group IV metal surface by brushing, rubbing or buffing.

The frictional application of the silicon powder can be carried out, of course, in a number of ways. The silicon powder can be applied, for example, by a mechanical buffer, a polishing wheel, or by air blasting. Alternatively, the silicon can be impregnated in a paper, cloth or buffer to facilitate its reaction during application of such impregnated paper, cloth or buffer to the surface of the article to be treated.

The silicon preferably is applied as a powder to the surface of the article. If the silicon is applied as a powder, it may be of a particle size smaller than about 100 U.S. mesh screen and usually in a particle size in a range from 100 to 300 U.S. mesh screen.

In any case, the contacts between the silicon and the Group IV metal are made with sufficient energy to improve corrosion resistance. The energy levels necessary to improve the corrosion resistance of the metal articles have not been specifically determined, but they are sufficiently low that manual rubbing of the two constituents together at room temperatures has a marked effect.

The mechanical contacts between silicon and the Group IV metal article may be at ambient temperatures, although elevated temperatures may be advantageous in some instances. In any case, silicon in solid phase is reacted with the surface of the Group IV metal in a solid phase.

The following examples are furnished by way of illustrations and not as limitations of the invention.

EXAMPLE I

A wrought rod of Rem-Cru Titanium Inc.'s titanium alloy C-1304M was provided. The surface was dull indicating the presence of a corrosion product on the surface. No cleaning operation was performed on the rod.

Some −300 mesh silicon powder of 99.0+% purity was put on a cloth. The powder was then frictionally applied by rubbing the powder on the rod. Surprisingly, a lustrous coating was formed during the rubbing process. The coating was smooth and tightly adherent to the rod.

The chemical composition of the coating is not precisely known, however, it is felt that it is predominantly $Ti_5 Si_3$ with the possibility of substantial amounts of Ti Si and some Ti $Si_2$ being present.

EXAMPLE II

The same procedure is followed as set forth in Example I except that a zirconium base metal article is treated with silicon powder.

EXAMPLE III

The same procedure is followed as set forth in Example I except that silicon powder is applied to a hafnium base metal article.

EXAMPLE IV

The same rod utilized in Example I was rubbed with a block containing carbon and boron. The same results obtained in Example I were observed.

While the exact nature of the surface reaction is now known, it is expected that the peritectic intermetallic compound $Ti_5 Si_3$ is formed and secondarily, if at all, the intermetallic compound Ti $Si_2$ with a substantial amount of Ti Si present. The intermetallic compound or compounds provide a coating that protects the surface of the base metal article at elevated temperatures and reduces the deterioration attributable to nitrification and oxification. As such, titanium articles prepared according to the invention will find application in high speed aircraft, nuclear reactors, turbine blades, rocket nozzles, heating elements, and other high temperature uses.

The invention has also been utilized with respect to the Group III metals.

EXAMPLE V

The exterior of an aluminum alloy coffee pot was rubbed with approximately 300 mesh boron powder. The surface which was treated brightened upon the hand rubbing and maintained its lustre after repeated use of the coffee pot to make coffee.

Similar results have been achieved with SAE 1020 steel, an iron metal article.

EXAMPLE VI

A SAE 1020 steel plate which was covered with the bluish corrosion product $Fe_3O_4$ was hand rubbed with silicon powder in one area and boron powder in an adjacent area. Both of the treated areas brightened to a lustrous finish which maintained its lustre after being heated to cherry red in an air atmosphere.

A micro-quantitative analysis was run on the surface of a steel article which had been treated with silicon in accordance with this invention. The analysis did not show the presence of silicon at the surface. Thus, it could not be established that an intermetallic compound of iron and silicon was formed at the surface. Accordingly, it is possible that another mechanism accounted for the beneficial results. It is to be expected that other Group III metals would exhibit similar results.

The invention has also been applied to a combination of Group II metal magnesium and the Group IV metal tin.

EXAMPLE VII

A pewter (tin) article was rubbed with a magnesium powder. The treated surface was lustrous and has remained so even though exposed to the air.

The invention has also been applied to the Group I metal copper.

EXAMPLE VIII

A piece of copper tubing was rubbed with silicon powder. The treated surface brightened to a lustrous finish and remained so even though exposed to the air.

It is also expected that similar results would be obtained with Magnesium-Beryllium, Molybdenum-Chromium, and Columbium-Phosphorus systems.

The invention produces several unexpected results. First, corrosion resistance has been improved without the need for complicated processes. The frictional application may be carried out at room temperature by a simple rubbing process. Second, a corroded alloy may be treated without surface preparation to form a lustrous surface.

While the invention has been described in terms of treating the surface of a metal article, it is apparent to one of ordinary skill in the art that it would work equally well with plated surfaces. In that case the metal or its alloy referred to would be the predominant constituent of the plated surface.

The above disclosure is by way of illustration and it is apparent that those of ordinary skill in the art will be able to utilize the invention in ways not described herein. However, it is intended that this invention is only limited by the scope of the appended claims.

I claim:

1. The method of coating a titanium article to improve the corrosion resistance of said titanium article comprising the steps of:

providing a titanium article; and frictionally applying solid silicon to at least a portion of the surface of said titanium article to form a corrosion resistant coating on the treated portion of said titanium article.

* * * * *